United States Patent [19]

Dotta

[11] Patent Number: 4,485,713

[45] Date of Patent: Dec. 4, 1984

[54] PUNCHING DEVICE

[76] Inventor: Angelo Dotta, Via Altabella 10, Bologna, Italy

[21] Appl. No.: 435,388

[22] Filed: Oct. 20, 1982

[30] Foreign Application Priority Data

Oct. 20, 1981 [IT] Italy ..... 3555 A/81

[51] Int. Cl.[3] ..... B26F 1/06

[52] U.S. Cl. ..... 83/543; 83/317; 83/328; 83/640

[58] Field of Search ..... 83/327, 328, 315–317, 83/543, 640, 641, 639

[56] References Cited

U.S. PATENT DOCUMENTS

| | | | |
|---|---|---|---|
| 704,941 | 7/1902 | Slick | 83/316 |
| 1,140,392 | 5/1915 | Novick | 83/328 X |
| 2,136,210 | 11/1938 | Hall | 83/316 |
| 2,406,808 | 9/1946 | Conner | 83/328 X |
| 2,440,848 | 5/1948 | Conner | 83/328 |
| 3,178,983 | 4/1965 | Brunson | 83/543 X |
| 3,381,562 | 5/1968 | Tapscott | 83/328 X |

*Primary Examiner*—Frank T. Yost

*Attorney, Agent, or Firm*—Harding, Earley, Follmer & Frailey

[57] ABSTRACT

A punching device comprising a pair of opposed complementary dies vertically guided by a pair of guide rods each rotatably connected to a crank pin to continuously punch band material moving between the dies. The crank pins rotate synchronously in opposed directions with their crank centers spaced only vertically relative to the working plane. Each of the dies supports a plurality of cooperating tools and the tools in one of the dies are independently axially movable male punches sealingly guided in ducts communicating with a closed chamber filled with a fluid.

3 Claims, 5 Drawing Figures

PUNCHING DEVICE

BACKGROUND OF THE INVENTION

This invention relates to a device for, preferably continuously, punching or pressing band material by a pair of cooperating dies.

In the prior art pressing and punching operations are usually carried out by fixed presses through which the material to be pressed moves continuously or with reciprocating motion. Continuous pressing is possible by using cylindrical rotary dies which however cannot always be adopted either for technical reasons or their high cost.

SUMMARY OF THE INVENTION

The invention provides a device for punching or pressing band material by a pair of vertically guided cooperating opposed complementary dies. The tools in one of the dies are independently axially movable male punches sealingly guided in ducts communicating with a closed chamber filled with a fluid. For continuously punching band material moving continuously or reciprocating between the dies, each of the latter is rotatably connected to a crank pin, with the two crank pins so connected that in rotating synchronously in opposed directions their crank centers simultaneously reach the smallest distance from the working plane.

Further features and advantages of the invention will appear from the following detailed description of a preferred embodiment thereof together with the accompanying drawings.

DESCRIPTION OF THE INVENTION

Figure 3:
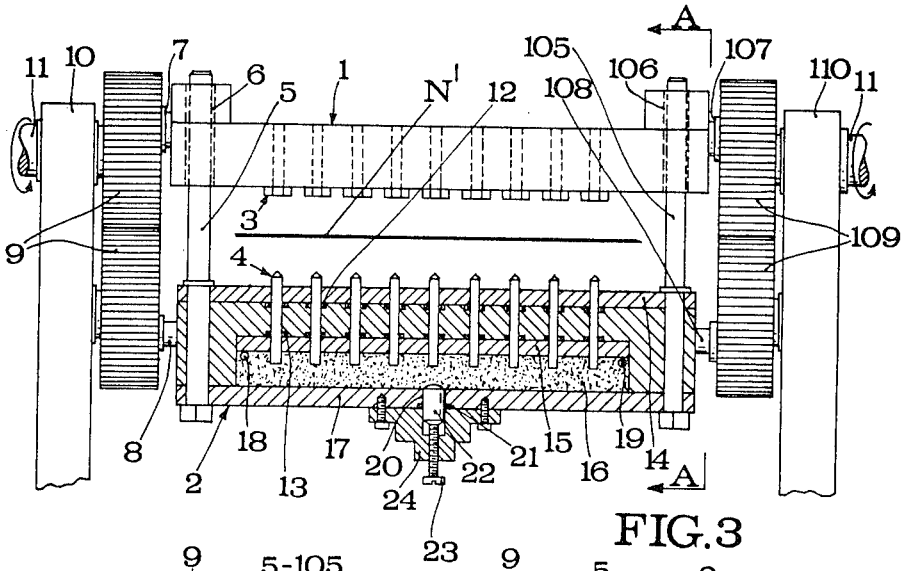
FIG. 3 is a partial section taken along the line III—III of FIG. 1 and on a larger scale to show further details of construction thereof.
Figure 2:
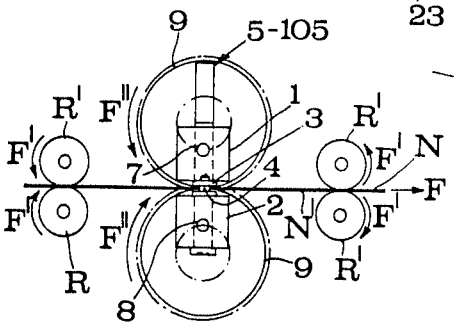
FIGS. 1 and 2 are schematic cross sections taken along the line A—A of FIG. 3 and showing the punching device according to the invention in the operative and inoperative position, respectively, the operative position being that in which the device engages and operates on the band material.
Figure 1:
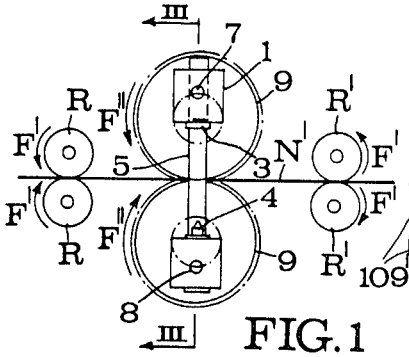

Referring first to FIGS. 1 and 2, a band material indicated by N is moved continuously in the longitudinal direction indicated by the arrow F by pairs of rollers R and R′ all or at least some of which are appropriately powered as indicated by the arrows F′ and preferably in such a manner as to suitably stretch the band portion N′ between the pairs of rollers. The punching device according to the invention operates on the band portion N′ and comprises a pair of opposed parallel complementary dies 1 and 2 arranged transversely of the band one above and the other below the band. As shown in FIG. 3, the upper die 1 carries female tools or matrixes 3 whereas the lower die 2 carries male tools or punches 4 arranged in a complementary fashion to the matrixes. The punches and matrixes are located in an ideal plane transversely of and perpendicularly to the band.

To enable the dies 1 and 2 to act on the band moving continuously therethrough, they are provided with appropriate mounting and support means which will now be described. First of all, the dies are interconnected by slidable guide means to keep them always parallel to each other and with the tools mutually centered. This guide means comprises a pair of parallel guide rods 5 and 105 firmly connected perpendicularly to the ends of one of the dies, for example the lower one, and slidably mounted in conjugated seats 6 and 106 in the upper die 1. The ends of the dies are rotatably mounted on crank pins 7 and 107, and 8 and 108, respectively, projecting from pairs of toothed wheels 9 and 109 having the same diameter, meshing with each other and rotatably mounted on support members 10 and 110. The axle of one of the toothed wheels 109 is denoted by 11 and that of the corresponding opposed toothed wheel 9 by 11′. These axles are so connected as to impart to the device a continuous rotation in the direction of the arrow F″. The crank pins 7 and 107 and 8 and 108 are eccentrically mounted on the associated toothed wheels 9 and 109 and the eccentricity of crank pins 7, 107 is the same as that of crank pins 8, 108 so that the punch and matrix portions intended to cooperate first with one another are located on ideal circumferences which are concentric with the toothed wheels 9, 109 and tangent on the band N′, these tool portions being intended to rotate on circular paths at a peripheral speed corresponding to the speed of linear feeding of the band N′.

As will be apparent from FIGS. 1 and 2, due to the synchronous rotation of the toothed wheels 9 and 109, the dies 1 and 2 cyclically move toward and away from each other and as they approach the band to cooperate therewith the dies move in the same direction and at the same speed as that of the band, preventing any undesired relative movment with respect to the band.

The following mechanism is provided to ensure satisfactory operation of the described device even in case of slight play between the toothed wheels 9 and 109 and tolerances in the construction and mounting of the various parts forming the device. The punches 4 are formed of cylindrical rods or stems having a circular cross section and mounted for axial laterally sealed movement in seats or ducts provided in the die 2. Lateral sealing of the punches 4 is ensured by sealing rings 12 and 13 retained in position by plates 14 and 15 secured to the body of the die 2. The lower ends of the punches or seats accommodating the punches communicate with a common chamber 16 provided in the body of the die 2 and sealingly closed by a plate 17. The chamber 16 is completely filled with a liquid through an inlet hole 18. A venthole 19 is provided in the chamber 16 to drain air therefrom and can also be closed by a suitable plug. The plate 17 is provided with a hole 20 receiving a piston 22 sealed laterally by a sealing gasket 21. The extent of penetration of the piston 22 in the hole 20 can be adjusted by means of a setscrew 23 supported by a cap member 24 secured to the plate 17.

Thus the punches 4 are interconnected by a hydrostatic connection which enables them to adapt themselves automatically to the female dies and permits them to operate simultaneously on the band to avoid excessive stress thereon and on the entire apparatus. The advantages obtained by this arrangement are obvious considering that the punches 4 are slightly shiftable transversely in their seats in which they have to move. In this manner the punches and matrixes do not have to be accurately aligned before starting operation. The device will correctly operate even if the punches 4 are of different lengths. This latter possibility simplifies the use of the device as variations in the length of the punches do not have to be considered when the punches have to be periodically sharpened. As the punches after sharpening would have their points removed from their ideal path of rotation, this removal can be compensated by adjusting the setscrew 23 to reduce the inner space of the chamber 16.

Thus, in addition to the described punching device the invention also comprises a hydrostatic compensation device which is independent from the mechanism for moving the dies as the latter is independent from the hydrostatic compensation device. Also numerous changes and modifications, particularly structural changes, obvious to one skilled in the art may be made in the described and illustrated preferred embodiment. As an alternative to or in combination with the hydrostatic compensation and connection device, a hydropneumatic connection device may be provided. Also a layer of hard or compressed rubber may be used for direct engagement by the stems of the punches 4 with the interposition of the liquid and/or with the provision of a fluid generally. With these modifications the punching device would be provided with a damping system which would ensure reliable operation and a long service life of the device also with high rates of rotation of the die moving means. According to a further modification the toothed wheels 9 and 109 may be made by the conventional technique of compensation of meshing backlash or the toothed wheels may be replaced by equivalent members such as positive displacement gears. Instead of connecting the dies by toothed wheels they may be connected by through cranks or crankshafts appropriately synchronized relative to one another.

Figure 4:
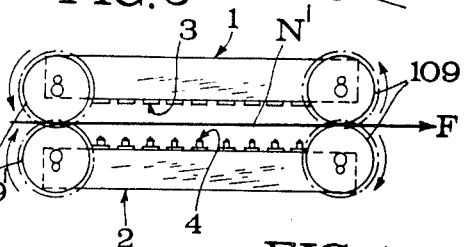
FIG. 4 is a diagrammatic side elevational view of another embodiment of the punching device.

FIG. 4 shows another modification according to which each die is driven by more than one crank gear, for example the crank gear pairs 109 and 109'. This would permit the use of very long dies provided with a plurality of groups of tools and would relieve the cranks of some of the load to ensure a more balanced and parallel arrangement of the system. In dies of the type shown in FIG. 4, each of the several groups of tools may be arranged to work on a portion of a predetermined set of indenting or punching operations.

As the band N' moves through the dies 1 and 2 of FIG. 4, the band portions corresponding to a complete revolution of the crank gears 109 and 109' would subsequently be located adjacent the various groups of tools and would leave the dies with all the identations and perforations provided therein. This arrangement would afford the advantage of containing and spacing a number of tools in each operating station and simultaneously the possibility of providing a very close pattern of indentations or perforations which could not have been made within the overall dimensions of the tools if the latter had been arranged in a single operating station of only one pair of dies of the noncomposite type.

Figure 5:
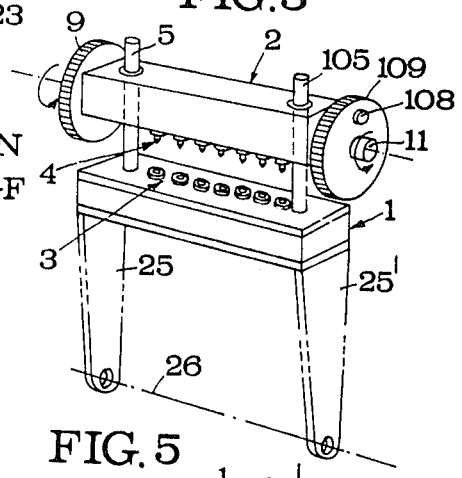
FIG. 5 is a diagrammatic perspective view of a further embodiment of the punching device.

FIG. 5 shows another modification in which the die 2 is arranged to perform an eccentric movement whereas the die 1 is driven to perform a swinging movement. For this purpose the die 1 is supported by a pair of levers 25 and 25' mounted for swinging movement on a common axis 26 extending parallel to the axis of rotation of the crank pins 108 on toothed gears 9 and 109.

For driving the toothed wheels or cranks, means different from those described may be provided and may be such as to act on both sets of wheels or crank gears. According to a further modification the punching device may be turned upside down with respect to the illustration in the drawings so that the die 2 carrying the punches would be located above the band. In this case the die 1 carrying the matrixes would be located below the band and this might facilitate the removal of scrap from the matrixes.

Alternatively the punches 4 may be of composite construction, i.e. they may be detachably connected to a stem portion operating in the die 2. These stem portions may be permanently connected to the die 2 without removing the connection when it is necessary to remove the tools for sharpening. Also different means may be provided for limiting axial shifting of the tools or to ensure lateral sealing thereof. For example, the seat for the sealing rings 12 and 13 may be provided directly on the stem portion of such movable tools. Alternatively or in combination with the embodiment described above, also the matrixes 3 may be provided with a compensation device. For this purpose the matrixes may pass through the body of the die 1 and may be formed with a step within the hydrostatic and/or elastic compensation chamber.

These and other modifications obvious to one skilled in the art are intended to be included within the scope of the invention as defined by the appended claims.

I claim:

1. A punching device for band material comprising at least one die containing a plurality of tools supported by stems slidably mounted in ducts provided in a base portion of said die and communicating with a closed chamber filled with fluid acting on lower end portions of said stems.

2. A punching device as claimed in claim 1, wherein said tools are of composite construction having an operating portion detachably mounted on one or more stem portions firmly connected to said die even when said operating portion is removed.

3. A punching device as claimed in claim 1, wherein said chamber filled with fluid is provided with a piston whose extent of penetration into said chamber can be adjusted to vary the inner volume of said chamber to thereby obtain the required degree of projection of said tools from said ducts toward said band material.

* * * * *